United States Patent [19]

Provence et al.

[11] Patent Number: 5,033,767

[45] Date of Patent: Jul. 23, 1991

[54] FRONT BINDING FOR SKI BOOT

[75] Inventors: Marc Provence, Groisy; Gerard Graillat, Annecy, both of France

[73] Assignee: Salomon S.A., Chavanod, France

[21] Appl. No.: 427,406

[22] Filed: Oct. 27, 1989

[30] Foreign Application Priority Data

Oct. 27, 1988 [FR] France ..... 88 14048

[51] Int. Cl.[5] ..... A63C 9/00

[52] U.S. Cl. ..... 280/615; 280/627; 280/634

[58] Field of Search ..... 280/615, 626, 627, 631, 280/632, 634

[56] References Cited

U.S. PATENT DOCUMENTS

| | | | |
|---|---|---|---|
| 3,884,488 | 5/1975 | Riedel | 280/632 |
| 4,343,486 | 8/1982 | Dysthe | 280/615 |
| 4,743,042 | 5/1988 | Järvinen | 280/615 |

FOREIGN PATENT DOCUMENTS

| | | |
|---|---|---|
| 0018336 | 10/1980 | European Pat. Off. . |
| 0163054 | 12/1985 | European Pat. Off. . |
| 3437725 | 4/1986 | Fed. Rep. of Germany . |
| 3528923 | 10/1986 | Fed. Rep. of Germany . |

*Primary Examiner*—Andres Kashnikow
*Assistant Examiner*—Eric Culbreth
*Attorney, Agent, or Firm*—Pollock, Vande Sande & Priddy

[57] ABSTRACT

A binding for keeping the front of a boot (3) positioned on a cross-country ski, comprising a locking slide (6) mounted so as to move longitudinally, when acted upon by a control device, in a slide channel (9) fastened to the upper surface of the ski, the locking slide having a hook (7) at one end extending transversely and unitary with a stem (8) inserted so as to slide in the longitudinal slide channel (9), and a frontal stop (12) extending transversely opposite the hook (7). A portion of the locking slide fits into a corresponding portion of the slide channel (9) or into an element unitary with this slide channel when the binding is locked into position.

8 Claims, 1 Drawing Sheet

FRONT BINDING FOR SKI BOOT

FIELD OF THE INVENTION

The present invention concerns a binding for maintaining the front of a ski boot in position on a cross-country ski.

BACKGROUND OF THE INVENTION

Front bindings for cross-country skis are already well-known in which a locking slide is mounted so as to move longitudinally in a slide channel fastened to the ski, when activated by a control lever jointed to the binding case. At its front end, this slide comprises a hook extending transversely which is unitary with a stem constituting its rearward projection and which extends horizontally above a footing attached to the upper surface of the ski. This stem is so engaged as to slide in a longitudinal slide channel fastened to the upper surface of the ski. Furthermore, the binding comprises a frontal stop extending transversely and located rearward of the binding case. This stop extends opposite the hook on the locking slide with which it cooperates to keep a transverse coupling pin mounted on the front portion of the sole of the boot positioned between the stop itself and the hook fitted on the slide. In the unlocked position, the locking slide is positioned so that the hook on the slide is kept at a distance from the frontal stop. The front of the boot may then be fastened to the binding by engaging the transverse pin unitary with the front end of the sole in the space formed between the hook and the frontal stop, this engagement occurring from top to bottom in the direction of the upper ski surface. Next, in order to lock the binding in position, one need only manipulate the binding control lever so as to move the locking slide and its hook until this latter comes into immediate proximity to the frontal stop. When this occurs, the hook clasps the coupling pin of the boot and holds it immobile between the hook itself and the frontal stop.

SUMMARY OF THE INVENTION

The present invention concerns improvements made to a binding of this kind for the purpose of improving the transverse position retention of the binding and the vertical transfer of stresses, and of eliminating manufacturing play.

Accordingly, this binding, which is designed to hold the front of the boot on the cross-country ski and which comprises a locking slide mounted so as to move longitudinally in a slide channel attached to the ski when acted upon by a control lever, the slide comprising, at one end, a transversely extending hook which is unitary with a stem engaged so as to slide in the longitudinal slide channel, and a frontal stop extending transversely and opposite to the hook on the locking slide with which it cooperates to keep a transverse coupling pin mounted on the front portion of the sole of the boot locked in position between the stop itself and the hook fitted to the slide, is characterized by the fact that a portion of the locking slide fits into an associated part of the slide channel or into an element unitary with this slide channel when the binding is locked in position.

According to a particularly advantageous embodiment of the invention, fitting of these pieces is achieved by prestressing. Accordingly, the locking slide is shaped so that, when in the locked position, a portion of the slide is elastically deformed and that, as a result of prestressing, the deformed part of the slide is forced elastically into contact with a stationary supporting surface. Because the locking slide undergoes prestressing, when this latter is placed in the locked position, play resulting from manufacture and wear is automatically eliminated, thus permitting greater manufacturing tolerances. Furthermore, in the locked position, the locking slide undergoes stress which is spread out uniformly, a phenomenon allowing placement of a plastic sliding piece between the locking slide and the slide channel, this piece presenting, therefore, no risk of being deformed at particular points in consequence of greater localized stresses. The automatic elimination of manufacturing play also allows greater stability and greater transverse position retention, and thus better control.

BRIEF DESCRIPTION OF THE DRAWINGS

Different embodiments of the present invention will be described below by way of example, with reference to the attached drawings in which.

DESCRIPTION OF THE PREFERRED EMBODIMENTS

Figure 1:
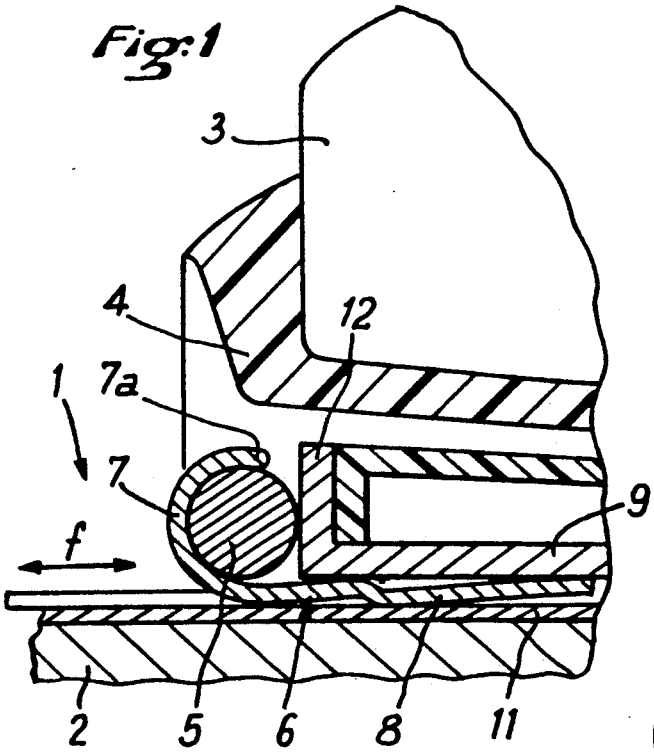
FIG. 1 is a partial vertical and longitudinal cross-section of the locked position of a front binding for a cross-country ski according to the invention.

FIG. 1 shows a binding 1 designed to hold in position, on a cross-country ski 2, the front of a ski boot 3 whose sole is fitted, at its front end, with a transverse coupling pin 5 extending in proximity to the lower surface of the sole 4. The front binding 1 comprises, in a conventional arrangement, a case to which a control lever or similar device is jointed, this lever causing the longitudinal movement of a locking slide 6. For purposes of simplicity, the binding case 1 and its control lever are not illustrated in the drawing. The means for providing the longitudinal movement of the locking slide 6 in both directions are indicated solely by the double arrow f on the drawing.

At its front end, the locking slide 6 comprises a transversely extending hook 7 which, in this embodiment, opens to the rear. Hook 7 is extended rearward by a stem 8 engaged in a longitudinal slide channel 9 fastened to a footing 11 which is itself fastened to the upper surface of the ski 2. The stem 8 of the slide 6 may thus slide longitudinally while being closely guided between the upper guide channel 9 and the lower footing 11. The front end of the slide channel 9 is unitary with a frontal wing 12 extending transversely and vertically upward. This wing 12 constitutes a frontal stop for the coupling pin 5 on the boot 3, which, in the locked position illustrated in FIG. 1, is held immobile between the hook 7, at this point in its extreme rearward position, and the frontal stop 12. In the unlocked position shown in FIG. 2, the hook 7 is shifted forward in a manner such that an adequate space is formed between the end *7a* of its upper arm 7*b* and the frontal stop 12, so as to allow the pin 5 to spring upward, thus releasing the shoe from the binding.

According to the invention, the locking slide 6 is shaped so that, in the locked position shown in FIG. 1, i.e., when the slide is inserted to its maximum extent in the slide channel 9, it is fitted within this slide channel 9 or in an element unitary with it. This fitting may be achieved with or without prestressing of the slide 6. If the fitting is formed by prestressing, the slide 6, made of an elastic material (e.g., sheet metal), is forcibly engaged in one portion of the slide channel 9 in such a way that it undergoes elastic deformation and that, because of this elastic deformation, it exerts pressure on a stationary upper supporting surface, said pressure contributing to the immovable retention of position and to elimination of play.

Figure 2:
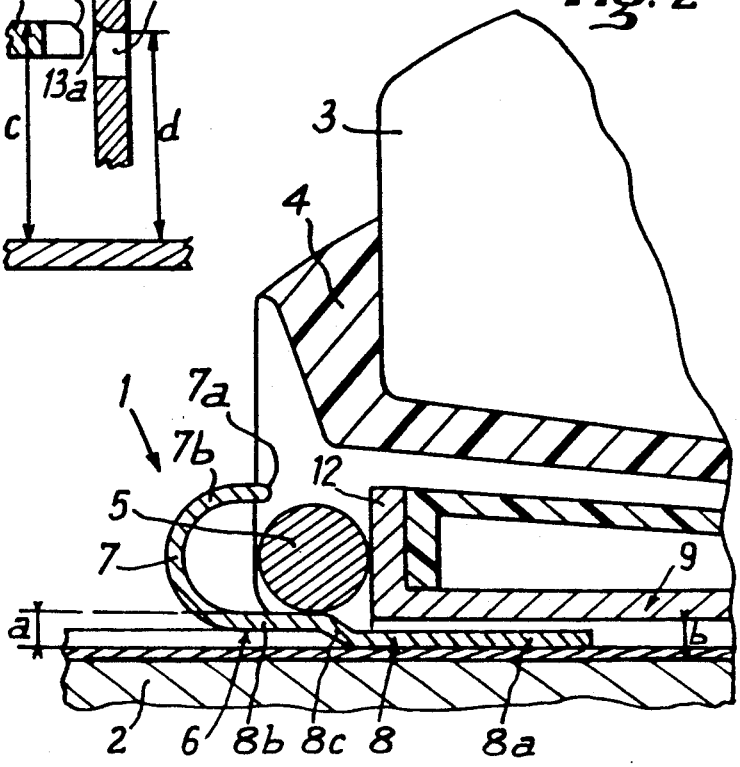
FIG. 2 is a vertical and longitudinal cross-section view of the front binding in FIG. 1, in unlocked position.

In the embodiment shown in FIGS. 1 and 2, this elastic deformation is obtained because the locking slide 6 has, in rest position (i.e., in the unlocked position shown in FIG. 2), a stem 8 which, when seen in vertical and longitudinal cross-section, is step-shaped. This stem 8 contains an inner part 8*a* (i.e., the part housed within the slide channel 9) in contact with the upper surface of the footing 11 while extending flat on this latter, and an outer part 8*b* to which the hook is attached and which extends horizontally a certain distance above the upper surface of the footing 11. Inner and outer parts 8*a* and 8*b* are connected to each other by means of an intermediate piece 8*c* extending substantially vertically. At rest, the camber of the stem 8 of the locking slide 6 is selected so as to ensure that the distance a between the upper surface of the outer part 8*b* of the stem 8 and the upper surface of the footing 11 is greater than height b of the opening of the slide channel 9, i.e., than the distance between the upper surface of the footing 11 and the lower surface of the upper wall of the slide channel 9, which constitutes the upper surface of the housing in which the locking slide 6 is engaged. Stem 8 has a thickness slightly less than height b of the opening of the slide channel 9. In consequence, when the locking slide 6 is shifted to the right from the unlocked position in FIG. 2 to the locked position shown in FIG. 1, the stem 8 undergoes elastic deformation at the moment when its outer part 8*b* having height a begins to engage in the opening of the slide channel 9 having height b, which is less than height a. In the locked position, the stem 8 of the locking slide 6 is then substantially deformed as shown in FIG. 1, its two parts, internal 8*a* and external 8*b*, being pressed under pressure against the lower surface of the upper wall of the slide channel 9, with partial "crushing" of the intermediate piece forming a spring plate. Accordingly, in its locked position the locking slide 6 fits tightly in the slide channel 9 while undergoing deformation and prestressing, and the vertical stresses which the coupling pin 5 on the boot 3 exerts on the hook 7 of the locking slide 6 are absorbed by the stationary slide channel 9 and in the complete absence of play. Furthermore, because the locking slide 6 is subjected to prestressing, manufacturing play is automatically taken up, thereby permitting greater manufacturing tolerances. The use of this arrangement also gives uniform stress over the locking slide 6 and, consequently, between this slide 6 and the slide channel 9, a plastic sliding piece may be positioned which cannot therefore undergo localized deformation such as would occur if this piece were subjected to major localized stresses. The elimination of play, obtained by the elastic deformation of the locking slide 6, also improves stability and transverse position retention, and, accordingly, better control.

Figure 3:
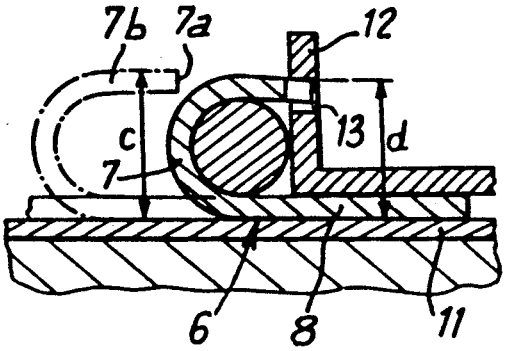
FIG. 3 is a partial and longitudinal cross-section view of an embodiment of the front binding according to the invention.

In the embodiment shown in FIG. 3, the elastic deformation of the locking slide 6 occurs at the hook. In this case, the stem 8 of the locking slide 6 is flat and is tightly engaged in the slide channel 9, the height of whose opening equals the thickness of the stem 8 of the slide channel 6. The frontal stop contains one or more holes 13 located substantially at the level of end 7*a* of the upper arm 7*b* of hook 7. End 7*a* is preferably notched so as to create one or more teeth capable of being inserted in the hole(s) 13 of the stop 12. The curvature of the hook 7 so selected that, when in the resting position, the distance c between the upper surface of the upper arm 7*b* of hook 7 and the upper surface of footing 11 is slightly greater than the distance d between the upper edge of each hole 13 in the stop 12 and the upper surface of the footing 11. Accordingly, when the locking slide 6 is moved to the right when in locked position, its upper arm 7*b* is forced to bend downward slightly so that its end 7*a* may be inserted in the hole 13, this occurrence resulting in the elastic deformation of the hook 7 which is thus fitted in position accompanied by slight prestressing. This arrangement allows the absorption of the stresses exerted vertically on the hook 7 by the pin 5 of the boot during cross-country skiing, these stresses being transferred from hook 7 to slide channel 9, thus producing substantial alleviation of the tension on the hook. However, fitting may also be achieved without prestressing, in which case the end 7*a* of the upper arm 7*b* of the hook 7 is inserted tightly in the hole(s) 13 without creating the elastic deformation of the hook 7. In the case of fitting without prestressing, absorption of the stresses by transfer from the hook to the slide channel 9 is also possible when the hook is forced upward.

Figure 4:
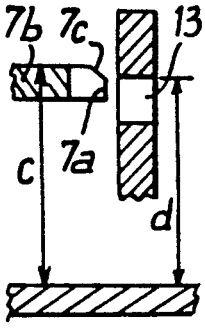
FIGS. 4, 5, and 6 are partial vertical and longitudinal cross-section views illustrating various embodiments of the end of the upper arm of the hook of the slide and of the hole in the frontal stop in which this hook is inserted.
Figure 5:
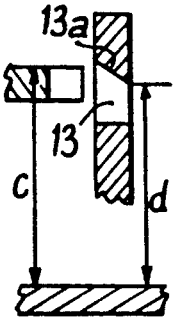
Figure 6:
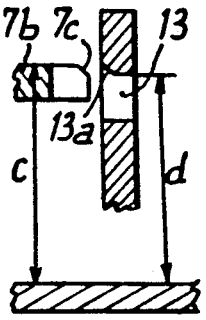

To allow the upper arm 7*b* of the hook to be fitted easily into the hole(s) under prestressing, the end 7*a* of the upper arm 7*b* and each hole 13 may have appropriate shapes, as shown in FIGS. 4, 5, and 6. In FIG. 4, the end 7*a* of the upper arm 7*b* of the hook 7 has a front, upper chamfer 7*c* which, when it comes into contact with the upper, horizontal edge of hole 13, causes the progressive, downward flexion of the upper arm 7*b*. In the embodiment shown in FIG. 5, it is the upper edge 13*a* of hole 13 which slopes downward so as to facilitate the insertion of the end 7*a* of the upper arm 7*b* in the hole 13. In the embodiment illustrated in FIG. 6, the hole 13 and the end 7*a* of the upper arm 7*b* each have a chamfer, 13*a* and 7*c* respectively, to facilitate insertion.

What is claimed is:

1. Binding for holding the front of a boot (3) on a cross-country ski, comprising a locking slide (6) mounted so as to move longitudinally in a slide channel (9) fastened to an upper surface of said ski, said locking slide terminating at one end, in a hook (7) extending transversely and unitary with a stem (8) engaged to slide in said longitudinal slide channel (9), and a frontal stop (12) extending transversely opposite to said hook (7) on said locking slide (6) with which said stop cooperates to hold a transverse coupling pin (5) fitted on a front part of a sole (4) of said boot (3) in a locked position between said stop itself and said hook (7), said binding enabling rotation of said boot about said coupling pin, wherein a portion of said locking slide is embedded in a corresponding part of one of said slide channel (9) and an element unitary with said slide channel when said binding is in said locked position.

2. Binding according to claim 1, comprising means for prestressing said locking slide in said locked position.

3. Binding according to claim 2, wherein said means for prestressing said locking slide consist of said stem (8) which, in vertical, longitudinal cross-section, is step-shaped and comprises a part (8*a*) housed within said slide channel (9) in contact with an upper surface of a footing (11) while extending flat on said footing, and an outer part (8*b*) to which said hook (7) is connected and which extends horizontally at a certain distance above said support surface (11), said inner and outer parts (8*a*, 8*b*) of said stem being connected by an intermediate part (8*c*) extending substantially vertically, and defining a camber of said stem (8) of said locking slide (6), said camber being predetermined so that, in a rest position, a distance (a) between the upper surface of said outer part (8*b*) of said stem (8) and the upper surface of said footing (11) is greater than a height (b) of an opening of said slide channel (9).

4. Binding according to claim 2, wherein said means for prestressing said locking slide consist of a combination of said element unitary with said slide channel (9), said element comprising said frontal stop (12) containing at least one hole (13) located substantially at an end (7*a*) of an upper arm (7*b*) of said hook (7), and of said end (7*a*) of said upper arm (7*b*), notched so as to form at least one tooth, said tooth being inserted without upward play into said at least one hole (13) of said stop (12).

5. Binding according to claim 4, wherein a curvature of said hook (7) is so predetermined that, in said rest position, a distance (c) between an upper surface of said upper arm (7*b*) of said hook (7) and the upper surface of a footing (11) is slightly greater than a distance (d) between an upper edge of each at least one hole (13) in said stop (12) and said upper surface of said footing (11), so that, when said locking slide (6) is moved to locking position, said upper arm (7*b*) is forced to bend slightly downward to permit insertion of said end (7*a*) in said at least one hole (13), thereby causing elastic deformation of said hook (7), which is thus fitted in position under slight prestressing.

6. Binding according to claim 5, wherein said end (7*a*) of said upper arm (7*a*) of said hook (7) comprises a front, upper chamfer (7*c*) which, by coming into contact with said upper edge (13*a*) of said hole (13), causes progressive downward flexion of said upper arm (7*b*).

7. Binding according to claim 5, wherein said upper edge (13*a*) of said hole (13) slopes downward so as to facilitate insertion of said end (7*a*) of said upper arm (7*b*) in said hole (13).

8. Binding according to claim 5, wherein said hole (13) and said end (7*a*) of said upper arm (7*b*) each comprises a chamfer (13*a*, 7*c*) to facilitate insertion.

* * * * *